US008913904B2

(12) United States Patent
Takami

(10) Patent No.: US 8,913,904 B2
(45) Date of Patent: Dec. 16, 2014

(54) IMAGE FORMING APPARATUS

(71) Applicant: Brother Kogyo Kabushiki Kaisha, Nagoya-shi, Aichi-ken (JP)

(72) Inventor: Yukiko Takami, Inazawa (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 153 days.

(21) Appl. No.: 13/751,002

(22) Filed: Jan. 25, 2013

(65) Prior Publication Data

US 2013/0195472 A1 Aug. 1, 2013

(30) Foreign Application Priority Data

Jan. 27, 2012 (JP) ..... 2012-015947

(51) Int. Cl.
*G03G 13/00* (2006.01)
*G03G 15/02* (2006.01)
*G03G 21/18* (2006.01)

(52) U.S. Cl.
CPC ..... *G03G 15/0266* (2013.01); *G03G 15/0283* (2013.01); *G03G 21/1875* (2013.01)
USPC ..... 399/13; 399/25; 399/50; 399/89

(58) Field of Classification Search
USPC ..... 399/13, 24–25, 45, 50, 88–89
See application file for complete search history.

(56) References Cited

U.S. PATENT DOCUMENTS 5,572,295 A 11/1996 Sakagami et al.
5,915,145 A * 6/1999 Shimura et al. ..... 399/66
6,516,158 B2 * 2/2003 Saito ..... 399/12
2012/0128382 A1 5/2012 Kondo et al.
2013/0195476 A1 * 8/2013 Yada et al. ..... 399/50

FOREIGN PATENT DOCUMENTS

| | | | |
|---|---|---|---|
| JP | H03-142483 | A | 6/1991 |
| JP | H04-003178 | A | 1/1992 |
| JP | H04-021875 | A | 1/1992 |
| JP | H05-323773 | A | 12/1993 |
| JP | H06-337600 | A | 12/1994 |
| JP | H07-020686 | A | 1/1995 |
| JP | H07-244420 | A | 9/1995 |
| JP | H11-133765 | A | 5/1999 |
| JP | H11-167241 | A | 6/1999 |
| JP | 2007-086229 | A | 4/2007 |
| JP | 2010-156780 | A | 7/2010 |
| JP | 2012-113117 | A | 6/2012 |
| JP | 2012-113118 | A | 6/2012 |

* cited by examiner

*Primary Examiner* — Christ Mahoney
(74) *Attorney, Agent, or Firm* — Merchant & Gould PC

(57) ABSTRACT

In an image forming apparatus, a plurality of cartridges each of which includes a photoconductor and a charger configured to charge the photoconductor is detachably installable in a main body housing. Chargers are connected in parallel to a voltage application unit configured to apply a voltage to the chargers. A cartridge installation determination unit is configured to determine whether or not each of the cartridges is installed. Control over the voltage application unit exercised by a controller includes a constant-voltage control and a constant-current control. The controller is configured to execute the constant-voltage control upon startup of an initial operation for preparation of printing and to switch from the constant-voltage control to the constant-current control if the cartridge installation determination unit determines that all the cartridges are installed.

5 Claims, 5 Drawing Sheets

IMAGE FORMING APPARATUS

CROSS-REFERENCE TO RELATED APPLICATION(S)

This application claims priority from Japanese Patent Application No. 2012-015947 filed on Jan. 27, 2012, the disclosure of which is incorporated herein by reference in its entirety.

FIELD

Apparatuses consistent with one or more aspects of the present invention relate to an image forming apparatus comprising a plurality of cartridges, each of which includes a to photoconductor and a charger configured to charge the photoconductor and is removably installed in a main body housing.

BACKGROUND

To reduce costs, the image forming apparatus may be configured such that the plurality of chargers are connected in parallel to a single common power source. Each cartridge (e.g., process cartridge) may be configured to include a corresponding charger and to be detachably installable in the main body housing of the image forming apparatus.

SUMMARY

Applicant previously proposed to provide an image forming apparatus in which chargers are connected in parallel to a single voltage application circuit configured to apply a voltage to the chargers under control such that the voltage is regulated to maintain an amount of an electric current found to be smallest among those of electric currents flowing through the chargers at a predetermined value. In this apparatus, if one of the cartridges each including a charger is not installed, then the voltage is regulated to raise the amount of the electric current at the position in which the charger is not present as the corresponding cartridge is not installed. Therefore, there is a risk of an excessively large voltage being applied to the chargers in the installed cartridges, which would possibly result in overcurrents flowing through the chargers.

It is one aspect of the present invention to provide an image forming apparatus which is capable of reducing the risk of an overcurrent flowing through one or more charging members.

More specifically, in one or more embodiments, an image forming apparatus is provided which comprises a main body housing, a plurality of cartridges, a voltage application unit, a cartridge installation determination unit, and a controller. Each of the cartridges includes a photoconductor and a charger configured to charge the photoconductor, and is detachably installable in the main body housing. To the voltage application unit, chargers are connected in parallel. The voltage application unit is configured to apply a voltage to the chargers. The cartridge installation determination unit is configured to determine whether or not each of the cartridges is installed. The controller is configured to exercise control over the voltage application unit, which control includes a constant-voltage control in which the voltage applied by the voltage application unit to the chargers is maintained at a predetermined voltage value, and a constant-current control in which an amount of an electric current found to be smallest among those of electric currents flowing through the chargers is maintained at a predetermined current value. The controller is further configured to execute the constant-voltage control upon startup of an initial operation for preparation of printing, and to switch from the constant-voltage control to the constant-current control if the cartridge installation determination unit determines that all the cartridges are installed.

BRIEF DESCRIPTION OF THE DRAWINGS

The above and other aspects, various embodiments, their advantages and further features of the present invention will become more apparent by describing in detail illustrative, non-limiting embodiments thereof with reference to the accompanying drawings, in which.

DESCRIPTION OF EMBODIMENTS

Figure 1:
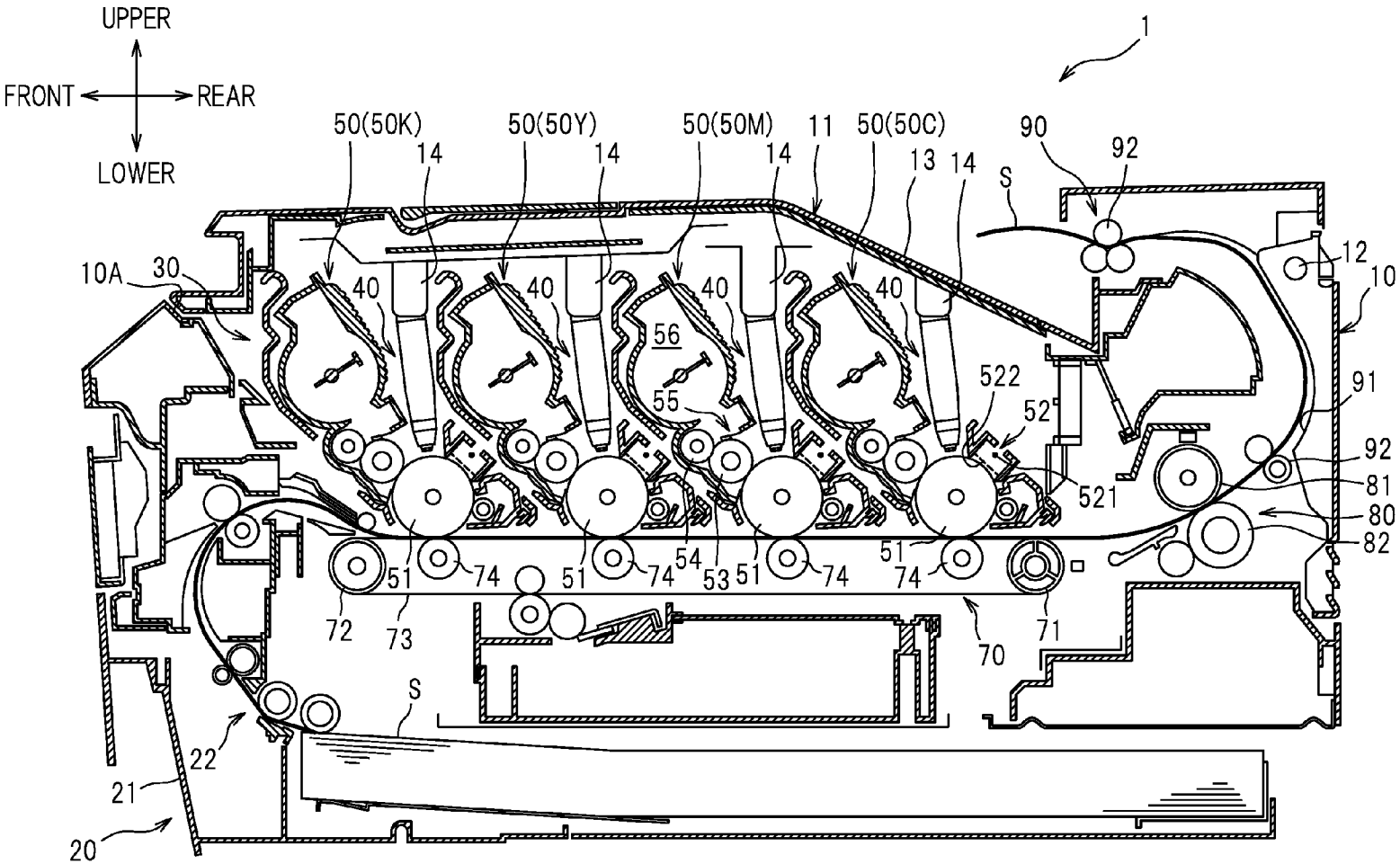
FIG. 1 is a schematic sectional view of a color printer as an example of an image forming apparatus according to an illustrative embodiment of the present invention.

A detailed description will be given of illustrative, non-limiting embodiments of the present invention with reference made to the drawings where appropriate. In the following description, a general setup of a color printer 1 as one example of an image forming apparatus according to one embodiment of the present invention will be described briefly at the outset, and then detailed features of the color printer 1 will be described in detail.

Hereinbelow, in describing the arrangement and operation of each component in the color printer 1, the direction is designated as from the viewpoint of a user who is using (operating) the color printer 1. To be more specific, in FIG. 1, the left-hand side of the drawing sheet corresponds to the "front" side of the printer, the right-hand side of the drawing sheet corresponds to the "rear" side of the printer, the front side of the drawing sheet corresponds to the "right" side of the printer, and the back side of the drawing sheet corresponds to the "left" side of the printer. Similarly, the direction of a line extending from top to bottom of the drawing sheet corresponds to the "vertical" or "up/down (upper/lower or top/bottom)" direction of the printer.

<General Setup of Color Printer>

As shown in FIG. 1, the color printer 1 comprises a main body housing 10, an upper cover 11, a sheet feeder unit 20 for feeding a sheet S (e.g., of paper) in the main body housing 10, an image forming unit 30 for forming an image on the sheet S fed by the sheet feeder unit 20, and a sheet output unit 90 for ejecting the sheet S on which an image is formed, to an outside of the main body housing 10.

The upper cover 11 is provided at a top side of the main body housing 10, and configured to be swingable on a pivot 12 located at a rear end thereof (i.e., a front end thereof movable upward and downward) relative to the main body housing 10 to accordingly open and close an opening 10A provided at the top side of the main body housing 10. The opening 10A is an opening provided to render the inside of the main body housing 10 accessible for maintenance of several components installed inside the main body housing 10.

Maintenance of several components of the color printer 1 installed inside the main body housing 10 may include replacement of a process cartridge 50 (a charger 52 therein) which will be described later by a new one, and cleaning of a charger 52 (a wire electrode 521 thereof). A specific method or structure for cleaning of the charger 52 is known in the art, and thus not detailed herein.

The sheet feeder unit 20 is provided in a bottom space within the main body housing 10, and mainly includes a sheet feed tray 21 configured to store sheets S therein, and a sheet feed mechanism 22 configured to feed a sheet S from the sheet feed tray 21 to the image forming unit 30. Sheets S in the sheet feed tray 21 are separated (uppermost one separated from others) and forwarded one by one to the image forming unit 30 by the sheet feed mechanism 22.

The image forming unit 30 mainly includes four LED units 40, four process cartridges 50 as an example of four cartridges, a transfer unit 70, and a fixing unit 80.

The LED units 40 are swingably supported by the upper cover 11. To be more specific, the upper cover 11 includes four holding portions 14 and each LED unit 40 is supported swingably on a corresponding holding portion 14 of the upper cover 11. When the upper cover 11 is in a closed position, each LED unit 40 is disposed opposite to an upper surface of a corresponding photoconductor drum 51. Each LED unit 40 includes a light-emitting part (an array of light-emitting diodes) disposed at a distal end thereof and configured to selectively emit light in accordance with image data, so that a uniformly charged peripheral surface of the corresponding photoconductor drum 51 is exposed to light.

The process cartridges 50 are disposed between the upper cover 11 and the sheet feed tray 21, and arranged in tandem in a front-rear direction. Each process cartridge 50 is configured to be detachable and installable (replaceable) in a substantially upward-downward direction from and in the main body housing 10 through the opening 10A of the main body housing 10 which becomes available (making the inside of the main body housing 10 accessible) when the upper cover 11 is swung open.

Each process cartridge 50 includes a photoconductor drum 51 as an example of a photoconductor, a charger 52, a development roller 53, a supply roller 54, a doctor blade 55, and a toner reservoir 56. The toner reservoir 56 is configured to store positively chargeable toner which is one example of developer.

The process cartridges 50 are comprised of four process cartridges 50K, 50Y, 50M, 50C for different colors, storing toner of black, yellow, magenta, and cyan, respectively, which are arranged in this sequence from an upstream of a direction of conveyance of a sheet S. In the following description and drawings, each component (i.e., photoconductor drum 51, charger 52, development roller 53) in a specific process cartridge 50 will be specified by its color, and designated by appending the corresponding suffix K, Y, M or C to the reference numerals (e.g., a charger 52C in a process cartridge 50C), where appropriate.

Figure 2:
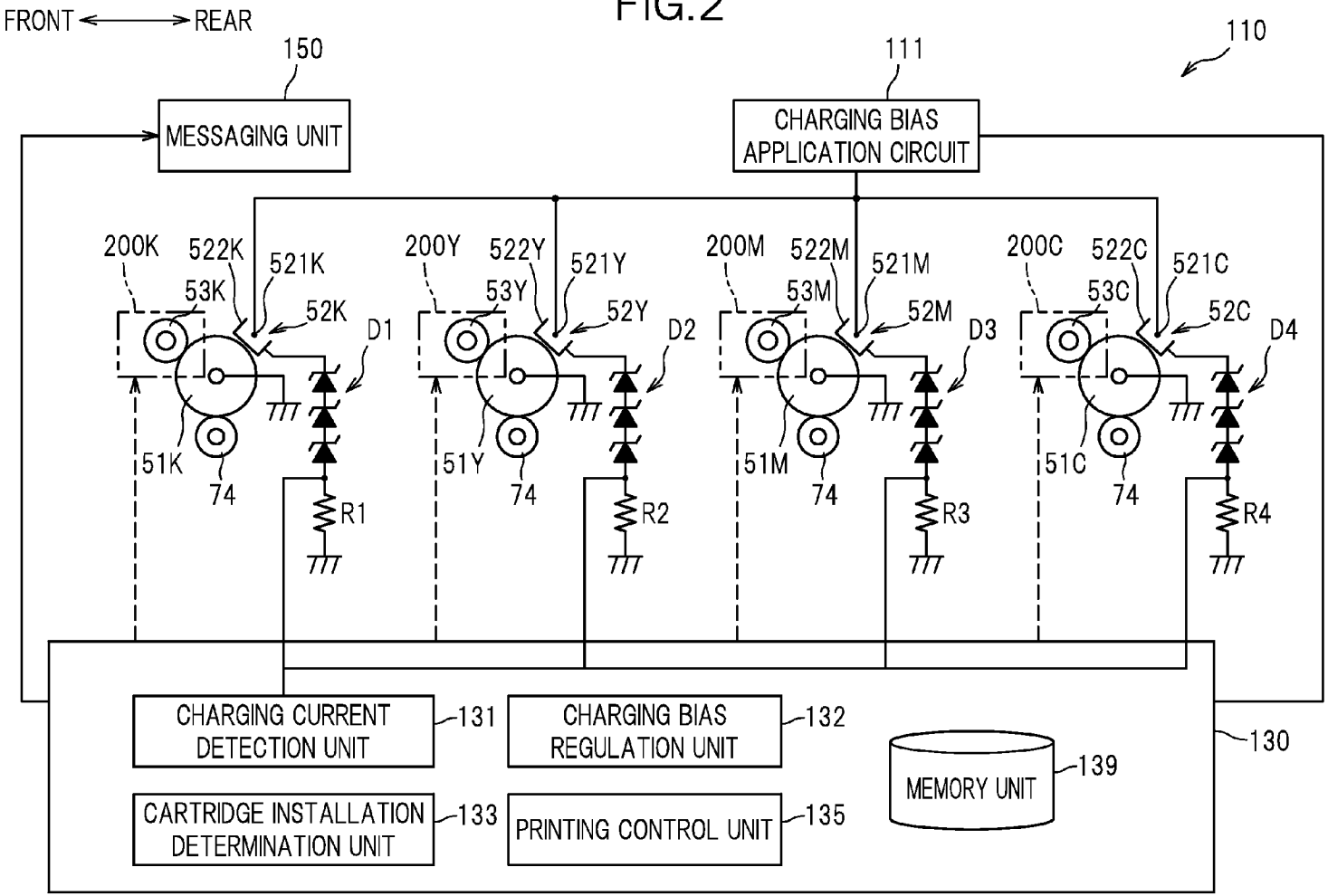
FIG. 2 is a schematic diagram showing chargers and associated systems and elements.

The photoconductor drum 51 is a known photoconductor including a cylindrical drum body possessing an electrical conductivity, a photoconductive (or photosensitive) layer formed on a peripheral surface of the drum body, and a shaft electrically connected to the drum body. The shaft of each photoconductor drum 51 is grounded as shown in FIG. 2.

The charger 52 is provided for each photoconductor drum 51, and mainly includes a wire electrode 521 and a grid electrode 522. This charger 52 is configured to generate a corona discharge when a charging bias (voltage) is applied thereto, so that the peripheral surface of a corresponding photoconductor drum 51 is positively charged.

The transfer unit 70 is disposed between the sheet feed tray 21 and the process cartridges 50, and mainly includes a driving roller 71, a driven roller 72, an endless conveyor belt 73 looped around the driving roller 71 and the driven roller 72, and four transfer rollers 74. The conveyor belt 73 is disposed with its outer surface kept in contact with the peripheral surfaces of the photoconductor drums 51, and the transfer rollers 74 are disposed at an inner surface of the conveyor belt 73 in positions corresponding to the respective photoconductor drums 51, i.e., such that the conveyor belt 73 is held between each transfer roller 74 and the corresponding photoconductor drum 51.

The fixing unit 80 is disposed rearwardly of the process cartridges 50 and the transfer unit 70, and mainly includes a heating roller 81 and a pressure roller 82 disposed opposite to the heating roller 81 and pressed against the heating roller 81.

In the image forming unit 30, the peripheral surfaces of the photoconductor drums 51 are uniformly charged by the chargers 52, and then exposed to light by the LED units 40, so that an electrostatic latent image formulated for each color based upon the image data is formed on the peripheral surface of each photoconductor drum 51.

Toner in each toner reservoir 56 is supplied through the supply roller 54 to the development roller 53 to which a development bias is applied, and (as the development roller 53 rotates) forwarded to pass through an interface between the development roller 53 and the doctor blade 55 so that a thin layer of toner having a predetermined thickness is carried on the development roller 53. In this process, the toner is positively charged by friction between the development roller 53 and the supply roller 54 and between the development roller 53 and the doctor blade 55.

When toner carried on the development roller 53 is supplied to an exposed region on the peripheral surface of the photoconductor drum 51, the electrostatic latent image is visualized, and a toner image is thus formed on the peripheral surface of the photoconductor drum 51. Thereafter, while a sheet S fed from the sheet feeder unit 20 is conveyed through an interface between the photoconductor drum 51 and the conveyor belt 73 (behind which the transfer roller 74 with a transfer bias applied thereto is disposed), the toner image formed on the peripheral surface of the photoconductor drum 51 is transferred onto the sheet S. The sheet S with the transferred toner image carried thereon is conveyed through an interface between the heating roller 81 and the pressure roller 82, so that the toner image is thermally fixed on the sheet S.

In the color printer 1, when a multicolor image is formed on a sheet S, toner images are formed on the peripheral surfaces of the photoconductor drums 51 of all the process cartridges 50, and while the sheet S is conveyed to pass through an interface between each photoconductor drum 51 and the conveyor belt 73, toner images for respective colors are transferred one after another, and superposed one on top of another, onto the sheet S. On the other hand, when a monochrome image is formed on a sheet S using black color toner only, a toner image is formed only on the peripheral surface of the photoconductor drum 51K of the process cartridge 50K where black toner is stored in the toner reservoir 56, and while the sheet S is conveyed to pass through an interface between the photoconductor drum 51K and the conveyor belt 73, the toner image for black is transferred onto the sheet S.

The sheet output unit 90 mainly includes a sheet output path 91 configured to guide a sheet S conveyed out from the fixing unit 80, and a plurality of conveyor rollers 92 configured to convey the sheet S along the sheet output path 91. A sheet S with a toner image thermally fixed thereon (i.e., sheet S on which an image is formed) is conveyed by the conveyor rollers 92 along the sheet output path 91, ejected out of the main body housing 10, and placed on the sheet output tray 13.

<Detailed Configuration of Color Printer>

As shown in FIG. 2, the color printer 1 further comprises a charging bias application device 110, a separation mechanism 200, a controller 130, and a messaging unit 150.

The charging bias application device 110 mainly includes a charging bias application circuit 111 as an example of a voltage application unit, four constant-voltage circuits D1, D2, D3, D4, and four electric-current detectors R1, R2, R3, R4.

The charging bias application circuit 111 is connected to four wire electrodes 521 arranged in parallel and thus configured to apply a common charging bias (voltage) to the wire electrodes 521. A specific configuration of the circuit for applying a charging bias to the wire electrodes 521 is known in the art, and a detailed description thereof is omitted herein.

The constant-voltage circuits D1-D4 are each composed of three Zener diodes connected in series, and configured such that the voltage applied to the grid electrode 522 of each charger 52 remains constant. The electric-current detectors R1-R4 are each composed, for example, of a resistor of which one end is connected to a corresponding constant-voltage circuit D1, D2, D3 or D4 and the other end is grounded.

The separation mechanism 200 is a known mechanism configured to move a development roller 53 to come in contact with or separate from the corresponding photoconductor drum 51 in the process cartridge 50 installed in the main body housing 10 between a contact position and a separate position. This separation mechanism 200 is operated under control of the controller 130, for example, to cause the development rollers 53Y, 53M, 53C to move away from a position in which each development roller 53Y, 53M, 53C is in contact with the corresponding photoconductor drum 51Y, 51M, 51C, when a monochrome image is formed only with black toner. By this operation, undesirable transfer of toner from the development rollers 53Y, 53M, 53C not used for image formation (monochrome printing) to the corresponding photoconductor drums 51Y, 51M, 51C can be suppressed, so that a sheet S can be prevented from being contaminated with stains of color toner.

The controller 130 is composed of several elements (not shown) which include a CPU, a RAM, a ROM, an input/output interface, and others. The controller 130 is configured to exercise control over various components (e.g., image forming unit 30, charging bias application device 110, etc.) of the color printer 1 in accordance with preconfigured programs and the like.

This controller 130 is configured to start up the color printer 1 when a sensor (not shown) detects that the upper cover 11 has been operated from an open position to a closed position, so that a warming-up operation (initial operation for preparation of printing) is started, for example, by causing the image forming unit 30 and other components to operate, to agitate toner in the toner reservoir 56, and to heat the heating roller 81. The "warming-up operation" is an operation performed until the color printer 1 becomes ready for printing, for example, until the surface temperature of the heating roller 81 is increased to a level adequate to fusing of toner for fixing a toner image on a sheet S.

This controller 130 comprises a plurality of functional units of which those related to the present invention mainly include a charging current detection unit 131, a charging bias regulation unit 132, a cartridge installation determination unit 133, a printing control unit 135, and a memory unit 139.

The charging current detection unit 131 has a function of detecting charging currents flowing through four wire electrodes 521, individually. To be more specific, the charging current detection unit 131 is wired to four points each located on connecting lines between one constant-voltage circuit D1, D2, D3 or D4 and a corresponding electric-current detector R1, R2, R3 or R4, so that the charging current detection unit 131 obtains a voltage in proportion to the magnitude of the charging current of each wire electrode 521 (more precisely, the electric current of each grid electrode 522). With this configuration, the charging current detection unit 131 takes a reading of the obtained voltage, to thereby detect a charging current flowing through each wire electrode 521.

From the charging currents flowing through the four wire electrodes 521 individually detected in the charging current detection unit 131 as described above, the controller 130 can obtain information on the presence or absence of each process cartridge 50 including a corresponding wire electrode 521 (i.e., whether or not each process cartridge 50 is installed), individually (for each color), as will be described later.

The charging bias regulation unit 132 is configured to exercise control over the charging bias application circuit 111 to regulate charging biases applied to the respective chargers 52. To be more specific, the charging bias regulation unit 132 is configured to execute a constant-voltage control and a constant-current control in the control over the charging bias circuit 111.

The constant-voltage control is a control scheme in which the charging bias application circuit 111 is controlled so that the charging bias applied to the chargers 52 is maintained at a predetermined bias value (predetermined voltage value) which will be described later. On the other hand, the constant-current control is a control scheme in which the charging bias application circuit 111 is controlled so that an amount of an electric current found to be smallest among those of charging currents flowing through the chargers 52 is maintained at a predetermined value.

By executing the constant-current control in which the charging bias application circuit 111 is controlled so that an amount of an electric current found to be smallest among those of charging currents flowing through the chargers 52 is maintained at a predetermined value, the surface potentials of the charged photoconductor drums 51 can be maintained at a desired value or greater. Therefore, a potential difference between the exposed region and an unexposed region on the photoconductor drums 51 during the printing operation is made greater to some extent such that adhesion of toner to the unexposed region can be suppressed and the risk of degradation in image quality such as a phenomenon called "fogging" can be suppressed.

In the present embodiment, when the warming-up operation is started, the charging bias regulation unit 132 regulates the voltages applied by the first charging bias application circuit 111 to thereby execute the constant-voltage control. The charging bias regulation unit 132 is configured to change the predetermined bias value from a first bias value (first voltage) to a second bias value (second voltage) different from the first bias value during a time when the constant-voltage control is being executed.

To be more specific, when the warming-up operation is started, the charging bias regulation unit 132 first regulates the charging bias applied to the chargers 52 (wire electrodes 521) by the charging bias application circuit 111 to a first bias value (predetermined bias value) of which an absolute value is smaller than that of a previously applied charging bias value (previous bias value) obtained from the memory unit 139.

Next, after a lapse of a predetermined period of time from the time of starting the application of the charging bias at the first bias value during the warm-up operation, the charging bias regulation unit 132 changes the predetermined bias value to a second bias value of which an absolute value is smaller than that of the first bias value to regulate the charging bias applied by the charging bias application circuit 11 to the second bias value. The charging current detection unit 131 is configured to measure the charging currents caused to flow through the respective wire electrodes 521, respectively, by application of the charging bias at the first bias value, and the charging currents caused to flow through the respective wire electrodes 521, respectively, by application of the charging bias at the second bias value, and to record the measured values of the charging currents in the memory unit 139.

The first bias value may be set appropriately at a fixed value predetermined by simulation or experiment or a value obtained by calculation using a predetermined formula. Such a fixed value may be, for example, a value smaller than the smallest value of the voltage applied in the printing control process (the value of voltage applied to wire electrodes 521 if they are all new, thus not contaminated and have resistances of their specification values). A value obtained by calculation usable for this purpose may be, for example, a value on the order of 70-80% of the previous value of the charging bias. Similarly, the second bias value may also be set at a predetermined fixed value, or a value obtained by calculation using a predetermined formula.

After starting the constant-voltage control process, if the cartridge installation determination unit 133 determines that all the process cartridges 50 are installed in the main body housing 10, then the charging bias regulation unit 132 switches its regulation scheme from the constant-voltage control to the constant-current control, under which the charging bias applied by the charging bias application circuit 111 is regulated. Switching of the control scheme from the constant-voltage control to the constant-current control performed by the charging bias regulation unit 132 when the cartridge installation determination unit 133 determines that all the process cartridges 50 are installed in the main body housing 10 takes place during the warming-up operation.

The charging bias regulation unit 132 also has a function of recording a value of a charging bias applied to the chargers 52 as previous values (previous bias value) in the memory unit 139, at each time of predetermined timing ("a predetermined time") in the printing control process. This predetermined time may be any point of time in the printing control process, which includes, for example, at a time when an image is formed on one sheet S, at a time when a processing for one printing job as instructed in the color printer 1 is completed, or at a time when a processing for a set of printing jobs as instructed in the color printer 1 are all completed (i.e., at a time of ending of printing). Alternatively, such "a predetermined time" in the printing control may be a time, for example, when the value of a charging bias applied to each charger 52 changes.

The cartridge installation determination unit 133 has a function of determining whether or not each process cartridge 50 is installed in the main body housing 10. To be more specific, the cartridge installation determination unit 133 is configured to obtain amounts of charging currents caused to flow through the chargers for respective colors, individually, by application of the first voltage and by application of the second voltage, respectively, during the constant-voltage control, to calculate a difference between first and second charging current values (first and second amounts) of electric currents caused to flow through each charger by application of the charging biases at the first and second bias values, respectively, and to compare the difference (absolute value) calculated for each charger with a predetermined installation determination reference value (second reference value) to thereby determine whether the difference is not greater than the predetermined installation determination reference value.

If the difference between the first and second charging current values is not greater than the predetermined installation determination reference value, then the cartridge installation determination unit 133 determines that the cartridge 50 including the corresponding charger 52 is not installed. If the difference between the first and second charging current values is greater than the predetermined installation determination reference value, then the cartridge installation determination unit 133 determines that the cartridge 50 including the corresponding charger 52 is installed.

The next discussion focuses on the principle by which the cartridge installation determination unit 133 makes a determination as to whether or not the process cartridge 50 is installed.

Figure 3:
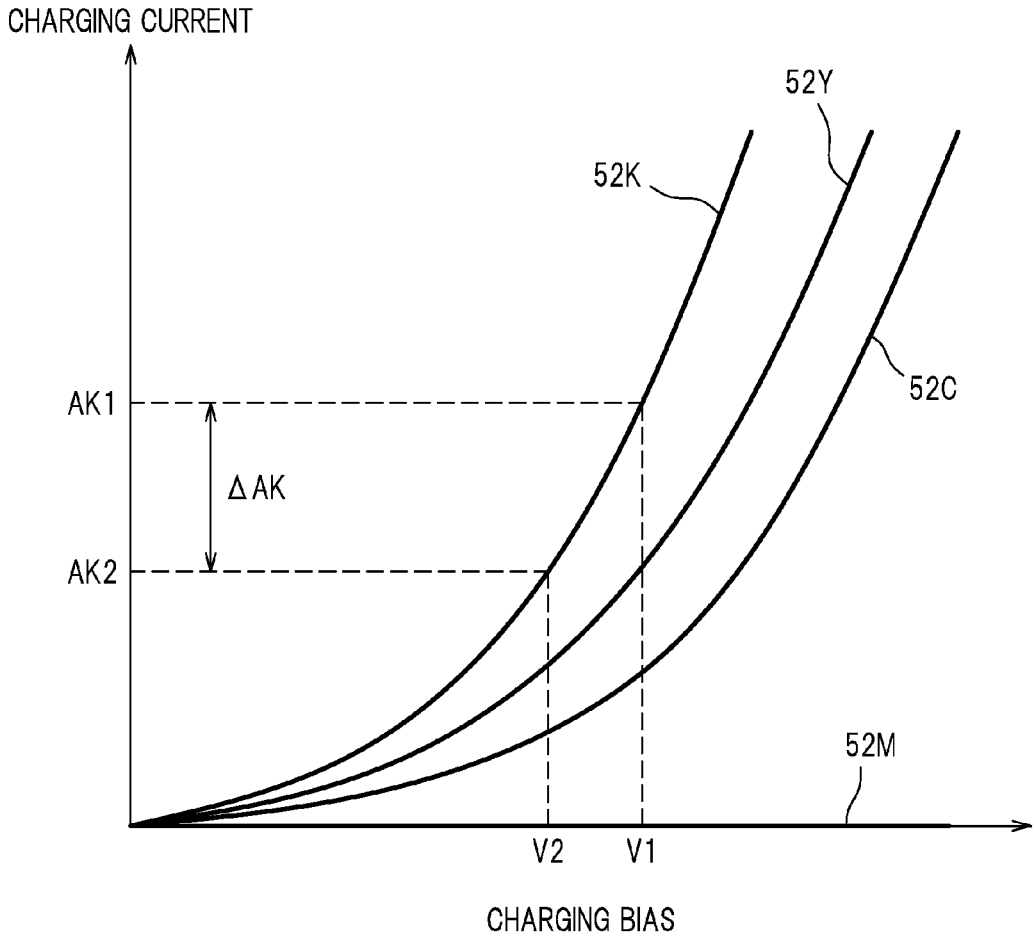
FIG. 3 is a graph showing relationships between charging bias and charging current.

If the process cartridges 50K, 50Y, 50C are installed, the relationship between the charging bias applied to the chargers 52K, 52Y, 52C and the charging currents caused to flow through the chargers 52K, 52Y, 52C by the charging bias may exhibit specific characteristics, for example, as represented graphically in FIG. 3 by reference characters 52K, 52Y, 52C, respectively. Therefore, for example, a difference ΔAK between a first amount AK1 and a second amount AK2 of charging currents caused to flow through the charger 52K by application of the charging bias at the first bias value V1 and by application of the charging bias at the second bias value V2 exhibits a great value to some extent.

On the other hand, if the process cartridge 50M (charger 52M therein) is not installed, no charging current is caused to flow by application of the charging bias. Accordingly, the first and second amounts of the charging currents for the charger 52M as obtained by application of the charging bias at the first bias value V1 and the second bias value V2 are both zero (specifically, the lower limit values the charging current detection unit 131 can detect). Therefore, the difference between the first and second amounts of the charging currents for the charger 52M becomes a value (approaching zero) smaller than the aforementioned difference ΔAK.

In the present embodiment, the installation determination reference value is set in view of the above-described characteristics, and if the difference between the first charging current value and the second charging current value is not greater than the installation determination reference value (the difference is small enough), then the cartridge installation determination unit 133 determines that the corresponding process cartridge 50 is not installed, while if the difference between the charging current value and the second charging current value is greater than the installation determination reference value (the difference is great enough), then the cartridge installation determination unit 133 determines that the corresponding process cartridge 50 is installed.

The cartridge installation determination unit 133, once determines that any process cartridge 50 is not installed, outputs information to that effect to the messaging unit 150. Accordingly, the messaging unit 150 can produce a notification that any of the process cartridges 50 is not installed to advise a user to that effect.

The printing control unit 135 has a function of controlling the printing operation (operation of forming an image on a sheet S) by exercising control over the charging bias application circuit 111, the sheet feeder unit 20, the image forming unit 30, and the like. To be more specific, when the color printer 1 receives image data (printing data) under the normal circumstances in which the cartridge installation determination unit 133 makes a determination that all the process cartridges 50 are installed, the printing control unit 135 performs a normal printing control under which a multicolor printing operation or a monochrome printing operation is executed with the charging bias regulated under the constant-current control.

When the color printer 1 receives image data under the circumstances in which the cartridge installation determination unit makes a determination that the process cartride 50K for black is installed and at least one of the process cartridges 50Y, 50M, 50C for colors other than black is not installed, the printing control unit 135 executes a monochrome printing operation with the charging bias regulated under the constant-voltage control.

Figure 4:
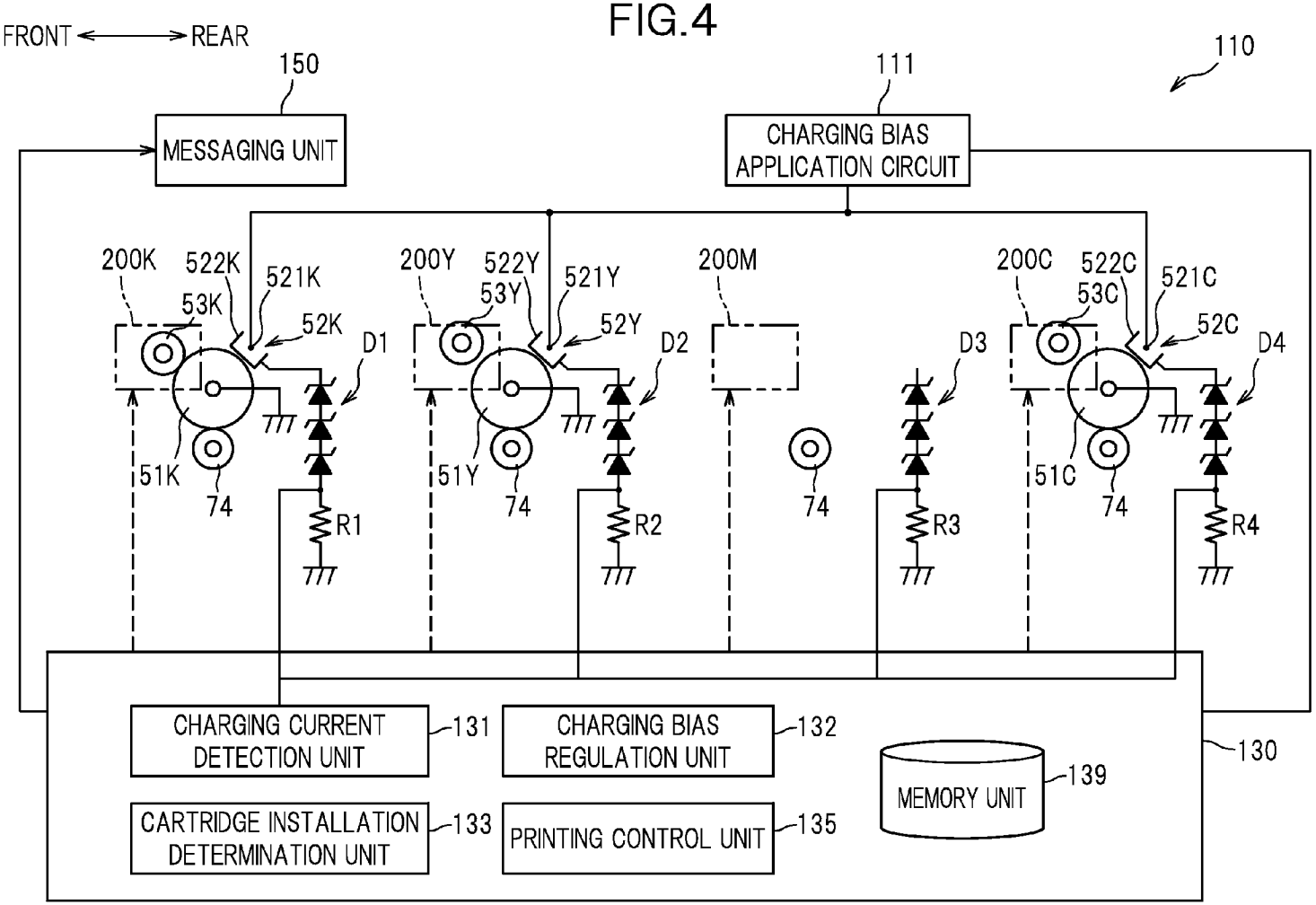
FIG. 4 is a schematic diagram similar to FIG. 2 but development rollers except that in a cartridge for black are separated.

Under the circumstances, the printing control unit 135 exercises control over the separation mechanism 200 so that the separation mechanism 200 is operated to separate the development rollers 53Y, 53C of the process cartridges 50Y, 50C for colors other than black installed in the main body housing 10, as shown in FIG. 4, from the corresponding photoconductor drums 51Y, 51C. FIG. 4 shows one exemplary situation in which the process cartridge 50M for magenta is not installed.

Although a detailed explanation will be omitted, when the monochrome printing is performed under the constant-voltage control, the printing control unit 135 regulates the value of the developing bias applied to the development roller 53K, the value of the transfer bias applied to the transfer roller 74, and the like, appropriately, in accordance with the charging bias applied to the charger 52K.

The messaging unit 150 has a function of producing a notification to the effect that any of the process cartridges 50 is not installed to give the notification to a user who uses the color printer 1. In the present embodiment, the messaging unit 150 is configured to be able to produce a notification to show, for each process cartridge 50, which is not installed and which is installed.

Although not illustrated, the messaging unit 150 may, for example, comprise four LED lamps which are provided on the main body housing 10 or the like as indicators for respective process cartridges 50, whereby a user can be notified, from lit or unlit statuses of these LED lamps, of the status of installation for each of the four process cartridges 50, i.e., which is installed and which is not installed. Furthermore, the messaging unit 150 may, for example, comprise a liquid crystal display which is provided on the main body housing 10 or the like, whereby a color name of the process cartridge (s) 50 not installed can be displayed so that a user can be notified of the uninstalled process cartridge(s), individually. Furthermore, the messaging unit 150 may be configured to produce a voice or sound message to advise a user of information by voice or sound.

Next, a detailed description will be given of the process of control exercised by the controller 130, with reference to the flowchart shown in FIG. 5.

Figure 5:
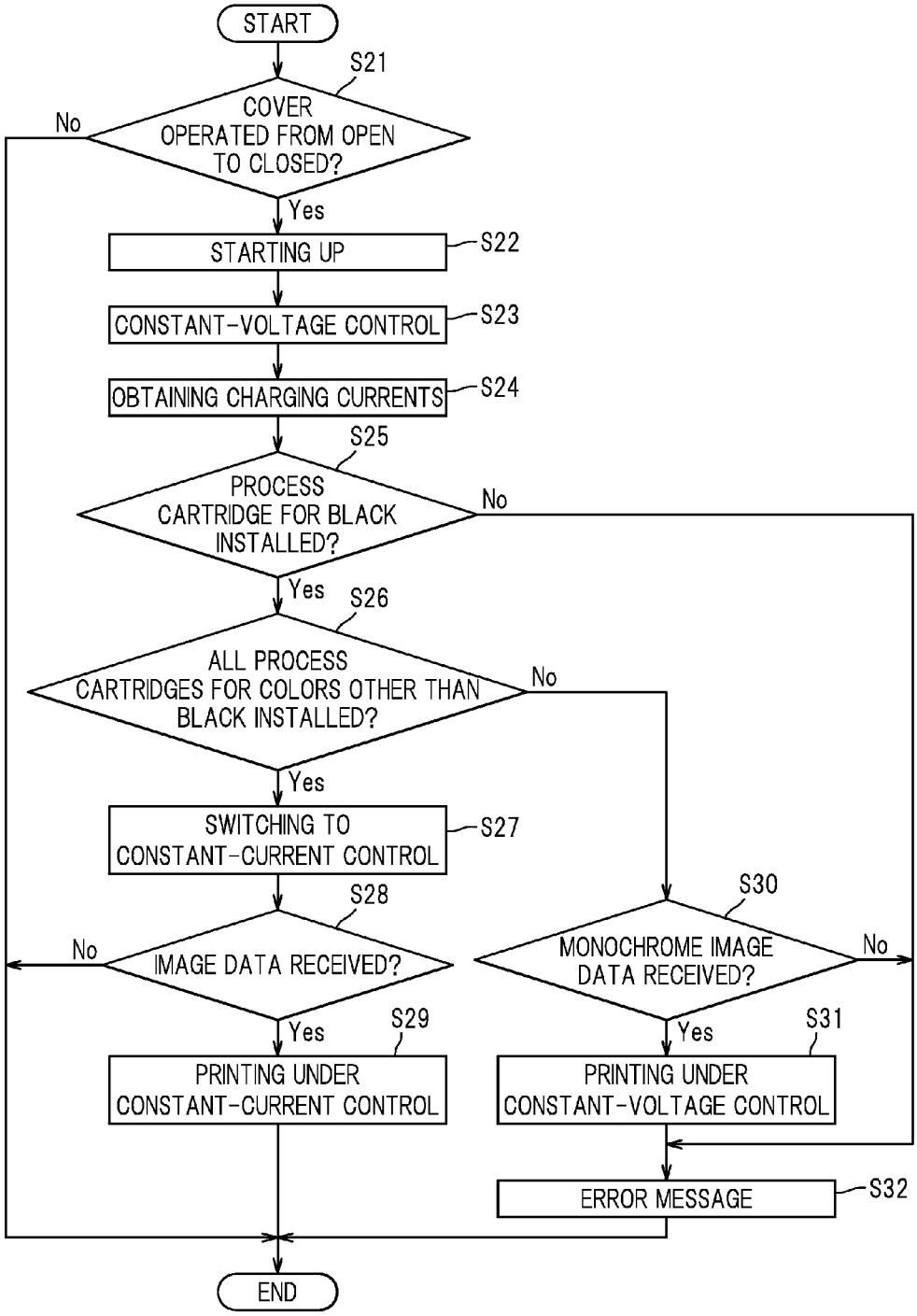
FIG. 5 is a flowchart showing an operation performed by a controller upon startup of the color printer.

As shown in FIG. 5, if the upper cover 11 is operated from the open state to the closed state (Yes in step S21), then the controller 130 starts up the color printer 1 to start the warming-up operation (S22), and executes the constant-voltage control (S23). At this time, the controller 130 first applies a first bias smaller than a previously applied bias recorded at the time of ending of the last printing operation to each wire electrode 521, and after a lapse of a predetermined period of time, applies a second bias smaller than the first bias to each wire electrode 521.

After starting execution of the constant-voltage control, the controller 130 obtains an amount of a charging current (first charging current and second charging current) from each grid electrode 522 (S24), and makes a determination as to whether there is any uninstalled process cartridge 50 (S25, S26). To be more specific, in step S25, a determination is made as to whether or not the process cartridge 50K for black is installed, and in step S26, a determination is made as to whether or not all the process cartridges 50Y, 50M, 50C for yellow, magenta, cyan other than black are installed.

If the controller 130 makes a determination that all the process cartridges 50 are installed (Yes in step S25 and Yes in step S26), then the controller 130 switches its control scheme adopted for control over the charging bias application circuit 111 from the constant-voltage control to the constant-current control (S27). Thereafter, the controller 130 makes a determination as to whether or not the color printer 1 has received any printing job (image data) (S28).

If the controller 130 makes a determination that the color printer 1 has received no image data (No in step S28), then the controller 130 brings the process shown in the flowchart of FIG. 5 to an end. If the controller 130 makes a determination that the color printer 1 has received image data (Yes in step S28), then the controller 130 executes the constant-current control under which a printing operation is carried out (S29), and when the printing ends, brings the process to an end. If the received (input) image data is for a monochrome image, the controller 130 exercises control over the separation mechanism 200 so that the separation mechanism 200 is operated to separate the development rollers 53Y, 53M, 53C from the corresponding photoconductor drums 51Y, 51M, 51C. With this operation, contamination of a sheet S with stains of color toner can be prevented.

If the controller 130 makes a determination in step S25 that the process cartridge 50K for black is not installed (No in step S25), then the controller 130 causes the messaging unit 150 to notify a user of occurrence of an error, more specifically, information to the effect that the process cartridge 50K for black is not installed (S32), and brings the process to an end.

If the controller 130 makes a determination that the process cartridge 50K for black is installed (Yes in step S25), but that at least one of the process cartridges 50Y, 50M, 50C for yellow, magenta, cyan other than black (e.g., process cartridge 50M for magenta) is not installed (No in step S26), then the controller 130 makes a determination as to whether or not the color printer 1 has received image data for a monochrome image (S30).

If no image data for a monochrome image has been received, i.e., no image data has been received or the received image data is not for a monochrome image but for an image using one or more colors other than black, then the controller 130 causes the messaging unit 150 to notify a user of occurrence of an error, more specifically, information to the effect that the process cartridge 50M for magenta is not installed (S32), and brings the process to an end.

If the controller 130 makes a determination in step S30 that image data for a monochrome image has been received (Yes in step S30), then the controller 130 exercises control over the separation mechanism 200 so that the separation mechanism 200 is operated to separate the development rollers 53Y, 53C from the corresponding photoconductor drums 51Y, 51C (see FIG. 4), and continues execution of the constant-voltage control under which a monochrome printing operation is carried out (S31). Thereafter, the controller 130 causes the messaging unit 150 to notify a user of occurrence of an error, more specifically, information to the effect that the process cartridge 50M for magenta is not installed (S32), and brings the process to an end.

According to the present embodiment, the following advantages can be achieved.

In the color printer 1, since the constant-voltage control is executed at the start of warming-up operation (upon startup of an initial operation for preparation of printing), the risk of increase of the charging bias applied to the chargers 52 when a process cartridge 50 (e.g., one of the process cartridges 50) is not installed can be eliminated. Accordingly, an undesirable overcurrent flowing through the chargers 52 in the installed process cartridges 50 can be suppressed. As a result, for example, an excessive electric discharge at the wire electrode 521 can be suppressed accordingly, with the result that generation of ozone associated with the corona discharge can be reduced and the useful life of the corresponding photoconductor drum 51 can be increased.

Since switching from the constant-voltage control to the constant-current control takes place during the warming-up operation in the above-described embodiment, the time required for rendering the color printer 1 printable can be shortened in comparison with an alternative embodiment in which switching from the constant-voltage control to the constant-current control takes place after completion of the warming-up operation.

Since amounts of charging currents flowing through the chargers 52 during the constant-voltage control are obtained individually to make a determination as to whether each of the process cartridges 50 is installed or not based upon the obtained amounts of the charging currents in the above-described embodiment, the need for any additional part such as a sensor which would otherwise be required for detecting the presence or absence of each process cartridge 50 in the main body housing 10 can be obviated. Consequently, the number of parts and the production cost can be reduced, and the miniaturization of the apparatus (color printer) can be made easy to achieve.

Since the predetermined voltage applied during the time of execution of the constant-voltage control is changed from a first voltage to a second voltage different from the first voltage, and a determination as to the presence or absence of each process cartridge 50 is made based upon the difference between first and second amounts of electric currents caused to flow through each charger by application of the first and second voltages (the biases at the first and second bias values), respectively, in the above-described embodiment, the influence of errors associated with detection of the amounts of charging currents on the determination can be reduced in comparison with an alternative embodiment in which a determination as to the presence or absence of each process cartridge 50 installed in the main body housing 10 is made based upon a single value (amount) of the charging current. Therefore, the cartridge installation determination can be made with increased accuracy.

Since a monochrome printing operation using the process cartridge 50K for black is performed under the constant-voltage control even if any one or more of the other process cartridges 50Y, 50M, 50C for yellow, magenta, cyan other than black is not installed, the convenience of users can be enhanced, and the risk of an undesirable overcurrent flowing through the chargers 50 of the installed process cartridge(s) 50 can be suppressed.

Although one illustrative embodiment has been described above, the present invention is not limited to this illustrative embodiment. Modifications and changes may be made where appropriate to its specific configurations without departing from the spirit and scope of the present invention.

In the above-described embodiment, the first and second bias values of biases (first and second voltages) applied during the constant-voltage control executed at the start of warming-up operation are set at predetermined values such that the absolute value of the second bias value is smaller than that of the first bias value, but the present invention is not limited to this specific setting. For example, the first and second bias values may be set such that the absolute value of the first bias value is smaller than that of the second bias value. It is preferable that the first and second bias values be set such that absolute values of the first and second bias values are both smaller than that of the value of previously applied bias.

In the above-described embodiment, the predetermined value of the voltage applied during the constant-voltage control is switched from the first bias value to the second bias value, and a determination as to the presence and absence of each process cartridge 50 is made based upon the difference between the first and second charging currents which are obtained when the bias is applied at the first and second bias values, respectively, but the present invention is not limited to this specific configuration. For example, the predetermined voltage value may be switched twice or more times during the constant-voltage control. In this alternative configuration, as well, a determination as to the presence or absence of the process cartridge 50 can be made based upon the three or more values (amounts) of electric currents obtained when the three or more different voltages are applied, respectively, to the charger in each process cartridge 50. Alternatively, the predetermined voltage applied during the constant-voltage control may not be switched (the predetermined voltage is maintained at a single value).

In the alternative configuration where the predetermined voltage is maintained at a single value, the cartridge determination unit 133 may be configured to obtain the amounts of charging currents flowing through the chargers 52, individually, during the constant-voltage control, and if an obtained amount is not greater than a determination reference value (first reference value), then determines that a process cartridge 50 including a corresponding charger 52 is not installed, and if an obtained amount is greater than the determination reference value, then determines that a process cartridge 50 including a corresponding charger 52 is installed. With this configuration, as well, the need for any additional part such as a sensor which would otherwise be required for detecting the presence or absence of each process cartridge 50 in the main body housing 10 can be obviated. Therefore, the number of parts and the production cost can be reduced, and the miniaturization of the apparatus (color printer) can be made easy to achieve.

In the above-described embodiment, when image data (printing data) for colors other than black is received under the circumstances in which at least one of the process cartridges 50Y, 50M, 50C other than the process cartridge 50K for black is not installed, the controller 130 simply produce an error message; however, the present invention is not limited to this specific configuration. For example, when image data (printing data) for colors other than black is received under the circumstances in which at least one of the process cartridges other than the process cartridge for black is not installed, the controller may execute a monochrome printing operation by converting the received image data for a multicolor image to image data for a monochrome image to form a monochrome image as an alternative.

In the above-described embodiment, all the chargers 52 are connected in parallel to a common voltage application unit (charging bias application circuit 111), but the present invention is not limited to this specific configuration. For example, only three of the total four chargers (e.g., chargers 52Y, 52M, 52C for colors other than black in the above-described embodiment) may be connected in parallel to one and the same voltage application unit. Moreover, two voltage application units may be provided, and each of the voltage application units may be connected to a plurality of chargers connected in parallel.

In the above-described embodiment, the cartridge installation determination unit 133 is configured to make a determination as to the presence or absence of each process cartridge 50 based upon the obtained amounts of the charging currents, but the present invention is not limited to this specific configuration. For example, the cartridge installation determination unit may be configured to make a determination as to the presence or absence of each process cartridge based upon detection results received from a sensor provided in the main body housing and configured to detect the presence or absence of the cartridge.

In the above-described embodiment, the color printer 1 (image forming apparatus) is configured to start up when the upper cover 11 is operated form an open state to a closed state, and to start the warming-up operation (an initial operation for preparation of printing), but the present invention is not limited to this specific configuration. For example, an image forming apparatus consistent with the present invention may be configured to start the warming-up operation upon startup which is initiated not only when the cover is closed but also when the power switch is turned on. Moreover, the image forming apparatus may be configured to enter the so-called "sleep" mode when no operation is performed for a predetermined time after the warming-up operation is initiated, and to start up and initiate the warming-up operation when the image forming apparatus exits the sleep mode in response to receipt of a printing job.

Although the above-described embodiment is configured such that switching from the constant-voltage control to the constant-current control takes place during the warming-up operation, the present invention is not limited to this configuration; for example, an alternative configuration may be feasible such that switching from the constant-voltage control to the constant-current control takes place after the warming-up operation.

Although the above-described embodiment is configured to detect charging currents flowing through the chargers 52 at the grid electrodes 522, the present invention is not limited to this configuration; for example, such detection may be done at the wire electrode 521. Furthermore, it is to be understood that a specific configuration for detecting electric currents may be any structure known in the art, not limited to the illustrated embodiment.

In the above-described embodiment, each charger 52 is configured to be a scorotron type charger comprising a wire electrode 521 and a grid electrode 522 by way of example, but the present invention is not limited to this specific configuration. That is, a charger of any other type may be usable as long as it is capable of charging a corresponding photoconductor by a corona discharge. For example, the charger consistent with the present invention may be configured as a corotron type charger including no grid electrode, or a pin array charger including an array of pin-like electrodes.

In the above-described embodiment, the process cartridge 50 comprising the development roller 53, the toner reservoir 56 and the like in addition to the photoconductor drum 51 (photoconductor), and the charger 52 is adopted as a cartridge by way of example, but the present invention is not limited to this specific configuration. For example, the cartridge provided in the image forming apparatus consistent with the present invention may be configured to comprise a detachable unit including a development roller and a toner reservoir.

In the above-described embodiment, the color printer 1 (image forming apparatus) comprises four process cartridges 50 and is configured to form four-color image, but the present invention is not limited to this specific configuration. For example, the image forming apparatus consistent with the present invention may comprise three process cartridges and be configured to form three-color image (e.g., yellow, magenta and cyan), or may comprise two process cartridges and be configured to form two-color image (e.g., black and red).

In the above-described embodiment, the present invention is applied to the color printer 1, but the present invention is not limited thereto. Any other type of image forming apparatus such as a photocopier with or without a flatbed scanner or other type of document reading device, a multifunction peripheral, etc. may be configured in accordance with the present invention.

In the above-described embodiment, positively chargeable toner is used as developer by way of example, but developer usable in an image forming apparatus consistent with the present invention is not limited thereto. Negatively chargeable toner may be used instead.

What is claimed is:

1. An image forming apparatus comprising:

a main body housing;

a plurality of cartridges, each of which includes a photoconductor and a charger configured to charge the photoconductor, the cartridges being detachably installable in the main body housing;

a voltage application unit to which chargers are connected in parallel and which is configured to apply a voltage to the chargers;

a cartridge installation determination unit configured to determine whether or not each of the cartridges is installed; and a controller configured to exercise control over the voltage application unit, which control includes a constant-voltage control in which the voltage applied by the voltage application unit to the chargers is maintained at a predetermined voltage value, and a constant-current control in which an amount of an electric current found to be smallest among those of electric currents flowing through the chargers is maintained at a predetermined current value, wherein the controller is further configured to execute the constant-voltage control upon startup of an initial operation for preparation of printing, and to switch from the constant-voltage control to the constant-current control if the cartridge installation determination unit determines that all the cartridges are installed.

2. The image forming apparatus according to claim 1, wherein the controller is further configured to switch from the constant-voltage control to the constant-current control during the initial operation after the cartridge installation determination unit determines that all the cartridges are installed.

3. The image forming apparatus according to claim 1, wherein the cartridge installation determination unit is further configured to obtain amounts of electric currents flowing through the chargers, individually, during the constant-voltage control, and to compare each of the obtained amounts of the electric currents with a first reference value to thereby determine that a cartridge is not installed if an obtained amount for a charger corresponding to the cartridge is not greater than the first reference value, and that a cartridge is installed if an obtained mount for a charger corresponding to the cartridge is greater than the first reference value.

4. The image forming apparatus according to claim 1, wherein the controller is further configured to change the predetermined voltage value from a first voltage to a second voltage different from the first voltage, during a time when the constant-voltage control is being executed, and wherein the cartridge installation determination unit is further configured to obtain amounts of electric currents caused to flow through the chargers, individually, by application of the first voltage and by application of the second voltage, respectively, during the constant-voltage control, to calculate a difference between first and second amounts of electric currents caused to flow through each charger by application of the first and second voltages, respectively, and to compare the difference calculated for each charger with a second reference value to thereby determine that a cartridge is not installed if the difference calculated for a corresponding charger included in the cartridge is not greater than the second reference value, and that a cartridge is installed if the difference calculated for a corresponding charger included in the cartridge is greater than the second reference value.

5. The image forming apparatus according to claim 1, wherein the controller is further configured to cause a monochrome printing operation using a cartridge for black to be performed under the constant-voltage control in response to printing data if the cartridge installation determination unit determines that the cartridge for black is installed and that at least one cartridge for color different from black is not installed.

* * * * *